United States Patent [19]

Yuscavage

[11] Patent Number: 4,877,254

[45] Date of Patent: Oct. 31, 1989

[54] BOARD GAME

[76] Inventor: John J. Yuscavage, 8 Gardner La., Mountaintop, Pa. 18707

[21] Appl. No.: 281,788

[22] Filed: Dec. 9, 1988

[51] Int. Cl.[4] ..... A63F 3/00

[52] U.S. Cl. ..... 273/249

[58] Field of Search ..... 273/243, 299, 250–254

[56] References Cited

U.S. PATENT DOCUMENTS

| | | | |
|---|---|---|---|
| 1,635,734 | 7/1927 | Ziegler | 273/249 |
| 4,201,388 | 5/1980 | Cantelon | 273/251 |
| 4,449,710 | 5/1984 | Davis | 273/249 |
| 4,682,777 | 7/1987 | Wood | 273/243 |

*Primary Examiner*—Edward M. Coven
*Assistant Examiner*—Edward M. Layno
*Attorney, Agent, or Firm*—Michael J. Delaney

[57] ABSTRACT

A board game includes separate player pieces, a timing device, a board, a random chance control device, general subject category cards and alphabet answer cards. The board has first and second spaces which define a travel path for the player pieces. The first spaces include indicia referring to a general subject category, and the second spaces include a question and indicia referring to a number, a color and a letter of the alphabet. The random chance control device includes a number, a color and a letter of the alphabet. The general subject cards correspond to the indicia on the first spaces and have a question relating to the general subject category and the answer to the question thereon. The alphabet answer cards correspond to the indicia of the second spaces and have answers to the questions appearing on the second spaces. The alphabet answer cards are arranged in alphabetical order with each card's answers further arranged by the numbers appearing on the second spaces.

6 Claims, 3 Drawing Sheets

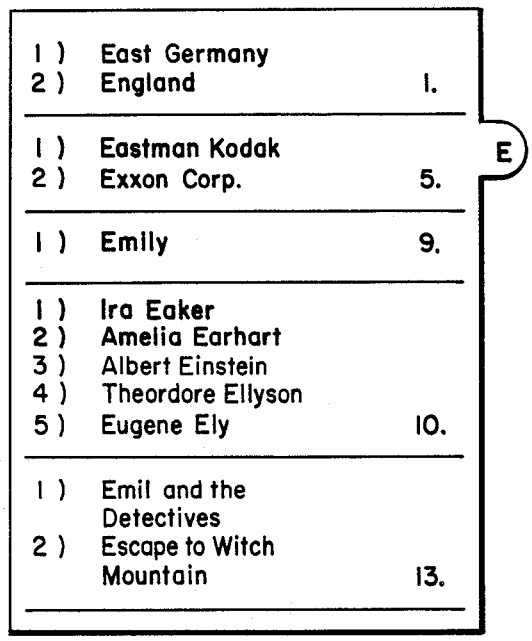
FIG. 4
FIG. 7
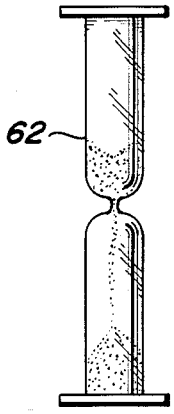
FIG. 8
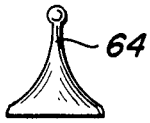
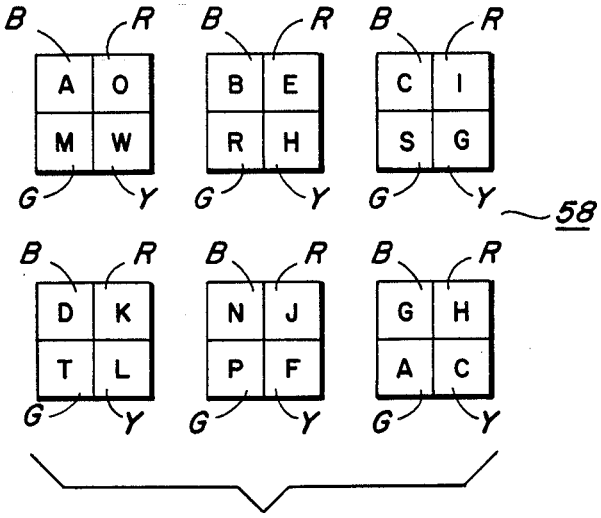
FIG. 5

BOARD GAME

BACKGROUND OF THE INVENTION

This invention is directed to a board game and more specifically to a board game played by two or more players based upon chance and upon the information and intelligence of the players.

SUMMARY OF THE INVENTION

It is an object of this invention to provide a board game which is interesting and instructive while also having an element of chance.

It is an object of this invention to provide a board game which includes a large number of questions on color coded board spaces to be answered by the players in combination with a color coded letter on a dice and to provide a system which allows the answers to such questions to be readily available to the players within a short time interval.

It is still another object of this invention to provide a board game which will appeal to a large group of players of various ages and maturity levels.

It is a further object of this invention to provide a board game to ask questions via color coded board spaces and a color coded letter on a dice and to enable the correct answers to such questions to be found quickly by use of the color coded letter and a number on such spaces.

The above objects are provided by the board game of this invention which comprises separate player pieces; a timing means; board means which include first and second spaces defining a travel path for the player pieces; the first spaces include indicia referring to a general subject category; the second spaces include a question and indicia referring to a number, a letter of the alphabet, and a color; random chance control means controls the movement of the player pieces along the travel path and indicates a number, a color and a letter of the alphabet; general subject category cards correspond to the indicia of the first spaces and include a question and answer thereon; and alphabet answer cards correspond to the indicia of the second spaces and include answers falling within the question, the alphabet answer cards are arranged in alphabetical order and further arranged by number, thereby providing for a large number of different answers relating to different questions to be found in a short period of time. cl

BRIEF DESCRIPTION OF THE DRAWINGS

FIG. 4 is a plan view of a single alphabet answer card.

FIG. 5 is a plan view of the six facets of one dice.

FIG. 7 is an elevation view of a timing means.

FIG. 8 is an elevation view of a player piece.

DETAILED DESCRIPTION OF THE DRAWINGS

Figure 1:
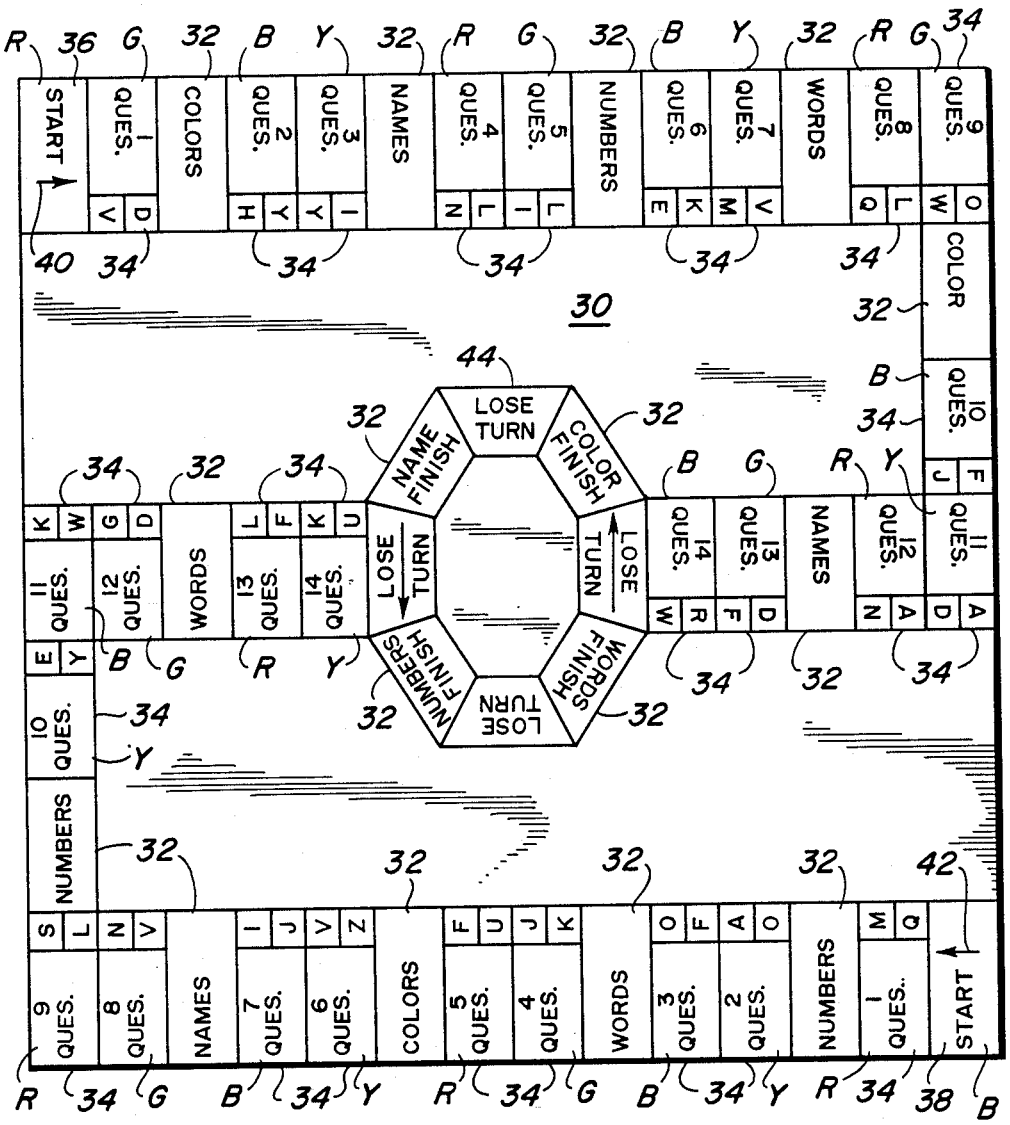
FIG. 1 is a plan view of the board means of this invention.

FIG. 1 illustrates the game board 30, which board 30 is made form material sufficiently rigid for its use as a game board. The board 30 is divided into a number of first spaces 32 and a number of second spaces 34. The board 30 also includes two starting spaces 36 and 38.

One starting space 36 is designated as a red start by the letter R for red and the other starting space 38 is designated as a blue start by the letter B for blue. As indicated the first spaces 32 have indicia referring to a general subject category, for example, "words", "colors", "names", and "numbers". As illustrated, second spaces 34 include indicia referring to a number, a question, a color and two letters of the alphabet. As shown the color of the second spaces 34 are indicated by an "R" for red, a "Y" for yellow, a "B" for blue, and a "G" for green. The following are examples of some questions which may appear on the second spaces 34 in the space where the word "Ques." now appears on FIG. 1 : "Beattles Top 20 singles", "European Countries", "Signers of the Declaration of Independence", "Cities as Sites of Olympic Games". Obviously these questions have multiple answers and are listed by way of example and not by way of limitation and numerous other questions of like nature will come to mind and could be listed as questions on the second spaces 34. Arrow 40 directs the path of travel for the Red (R) start and arrow 42 indicates the path of travel for the Blue (B) start. As shown, both paths lead to the center 44 of the game board 30 where the paths then move in a counterclockwise direction.

It will be noted that the red start 36 path and the blue start 38 path includes an equal number of spaces of like identity to reach the center 44 of the board 30. It should also be noted that the paths could be arranged in a different manner and include more or less first spaces 32 and second spaces 34. In addition, other types of spaces could be added to the board 30 in addition to spaces 32 and spaces 34. Such other spaces could include (in addition to others which may come to mind) lose turn(s), back-up space(s), advance space(s). It should also be pointed that each second space 34 will have an actual question thereon in the place of the word "Ques." shown in FIG. 1.

Figure 2:
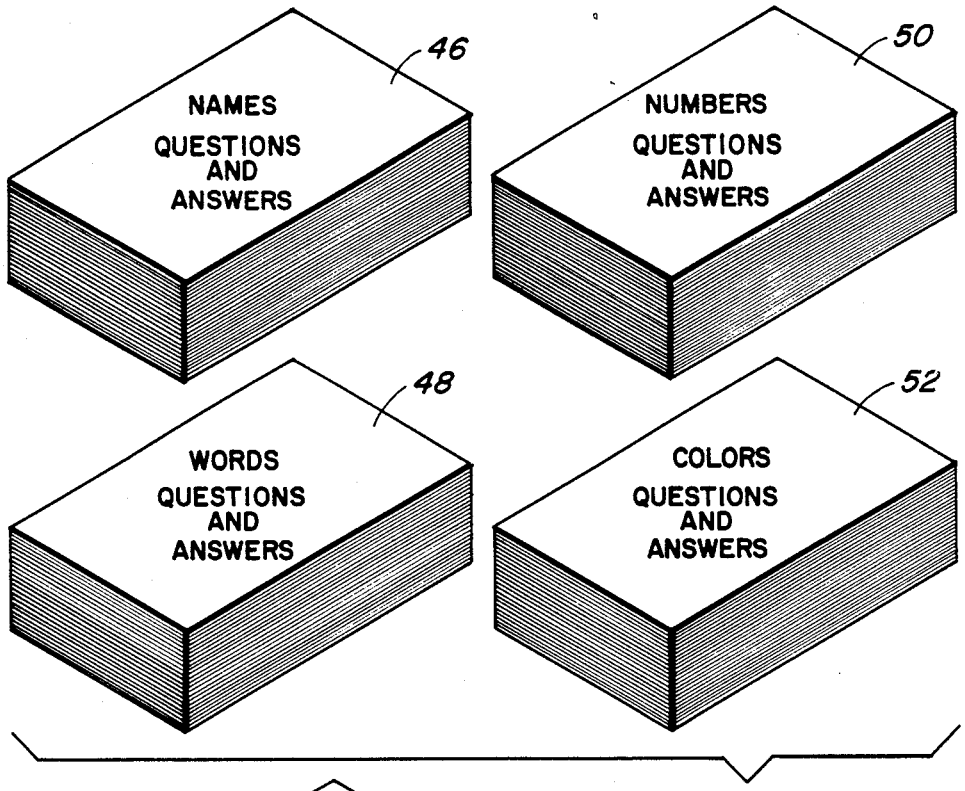
FIG. 2 is a perspective view of the general subject cards.

FIG. 2 illustrates a stacks of general subject cards 46, 48, 50 and 52, corresponding to the indicia which appears on the first spaces 32, i.e., "Names", "Words", "Numbers", and "Colors". Each general subject card includes a question on one side relating to either names, words, numbers or colors and an answer on the other side or in such a position as not to be seen when the question is read.

Figure 3:
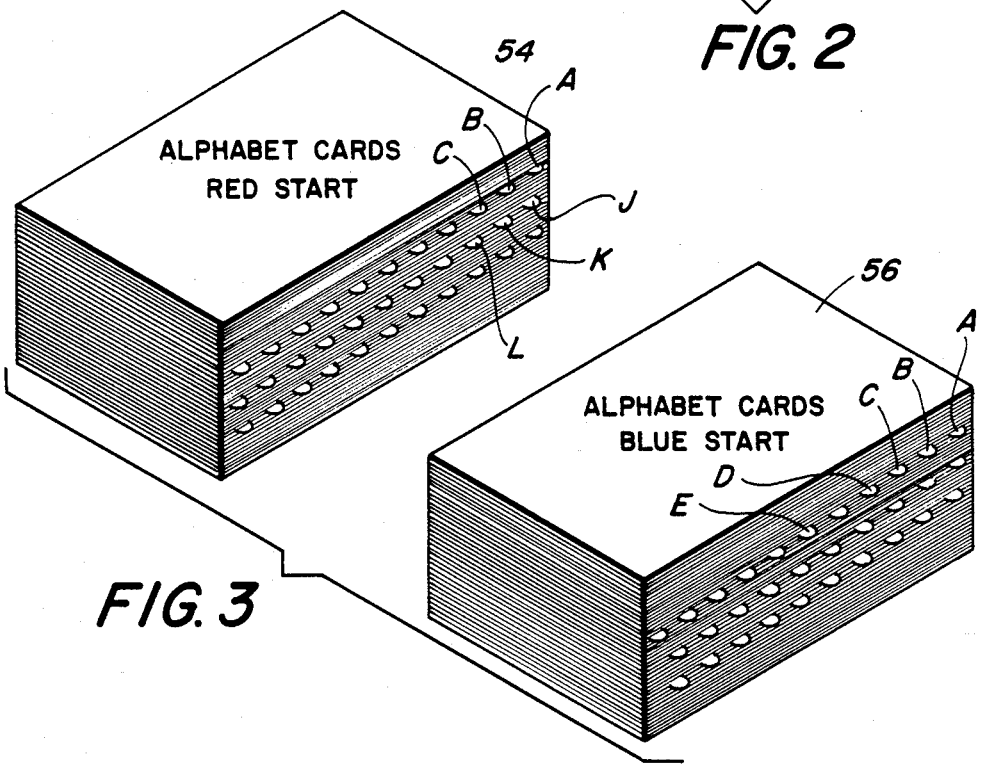
FIG. 3 is a perspective view of the alphabet answer cards.

FIG. 3 shows stacks of alphabet answer cards 54 and 56 for the Red start 36 and for the Blue start 38, respectively, having letter tabs, A, B, C etc. The alphabet answer cards 54 and 56 are arranged in alphabetical order and each card of each stack also has its listing arranged in numerical order and includes answers for the questions appearing on the second spaces 34.

FIG. 4 is an illustration of one alphabet answer card from the stack 56 of alphabet answer cards for the blue start 38 for the letter E. The letter E is color coded red and appears on one facet of dice 68. Second spaces 34 having the color code red are second spaces 34 which have a number indicia 1, 5, 9 and 13. The letter E appears as a letter of the alphabet on blue start 38 second space 34 having the number indicia 10. Thus the possibility is present on the game board 30 to require a player to provide an answer beginning with the letter E to the questions on second spaces 34 which have the number indicia 1, 5, 9, 10 and 13. In other words, if the player piece 64 of a play lands on second spaces 34 having the number indicia 1, 5, 9 or 13 which spaces also have the color code red thereon, and if the dice 58 lands with the facet having the letter E thereon facing upwardly, the player then must answer the question on second space 1, 5, 9 or 13 with an answer beginning with the letter E, since second spaces 1, 5, 9 and 13 are color coded red and letter E on one facet of dice 58 is also color coded red. Also if the player piece 64 of a player lands on second space 34 having the number indicia 10 thereon and if previously a player piece 64 had landed on the same second space 34 and also if at such previous time and at the present time the same facet of the dice 58 faced upwardly, the player would be required to provide an answer to the question on such second space 34 beginning with the letter E, because to do otherwise would result in the second player knowing the answer since prior player would have been asked the same question with the answer beginning with the same letter. While the above description related to second spaces 34 having number indicia 1, 5, 9, 10 and 13, the blue start 38 and the answer card for the letter E, the same description applies similarly to the other second spaces, the red start 36, all the other answer cards and the other letters.

The questions on second spaces 1, 5, 9, 10 and 13 could be as follows: "European and Asian Countries" for number indicia 1; "50 Most Active Stocks in 1986" for number indicia 5; "Top New Baby Girl Name in 1986" for number indicia 9; "National Aviation Hall of Fame Pioneers of Air and Space" for number indicia 10; and "Walt Disney Films" for number indicia 13. The answers to such question for the letter E appear on the alphabet answer card shown in FIG. 4. The other second spaces 34 would have other questions thereon and the other alphabet answer cards would have answers to such other questions keyed by the letter of the alphabet and the number indicia appearing on the second spaces 34.

FIG. 5 illustrates the six facets of a dice 58. Each facet of dice 58 is divided into four sectors with each sector colored as indicated. The letter "B" means that the sector is colored blue, "R" for red, "G" for green, and "Y" for yellow. As shown, each sector has a letter of the alphabet appearing thereon. If desired, instead of the sectors of dice 58 being color coded, the letters appearing on the dice 58 could appear in color.

Figure 6:
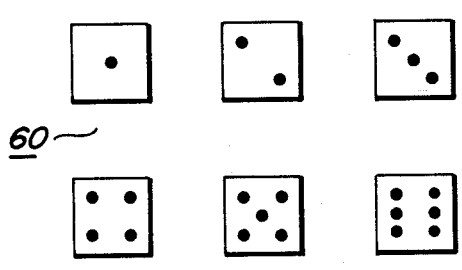
FIG. 6 is a plan view of the six facets of another dice.

FIG. 6 illustrates the six facets of another dice 60. Each facet of dice 60 has a number of dots thereon. The number accorded each facet of dice 60 is equal to the total number of dots on each facet, i.e., the facets have numbers 1–6 inclusive thereon.

The dice 58 and 60 are used in the playing of the game of this invention as a random chance control means. It should be noted that other random chance control means could be used in the practice of this invention, for example wheels, spinners and various random selecting means and others which come to mind.

FIG. 7 shows one type of a timing device 62 which is commonly known as an hour glass and which functions in a manner too well known to require further description.

FIG. 8 shows a player piece 64. Each player playing the game uses a player piece 64 to traverse the travel path on the game board 30.

The game may be played in accordance with the following set of instructions:

(1) Each player rolls the numbered dice 60 to determine who starts the game and where each player will start. The player rolling the highest number on the dice 60 begins the game and has his or her choice of starting either on the red or the blue start, 36 and 38 respectively. The player who rolls the next highest number on the dice 60 starts second on the start (red or blue) not selected by the first player. The player who rolls the next highest number starts next on the same start (red or blue) selected by the first player, and so forth for the other players.

(2) The first player then rolls the numbered dice 60 and the dice 58 having letters and colors. The player moves his player piece 64 along the travel path of the board 30 the number of spaces indicated by the number of the dice 60. If the player lands on a first space 32 having a general subject category thereon, the player selected a general subject category card from the stack of cards 46, 48, 50, 52 for the category of the first space 32 occupied by player piece 64 and attempts to answer the question thereon. If the player lands on a second space 34, the player is required to answer the question which appears thereon with an answer having its first letter the same as the letter appearing in the color sector of the dice 58 which color corresponds to the color of the second space 34 occupied by player piece 64. If the player correctly answers the question on the general subject category card or the question on the color coded space, the player is awarded another roll of the dice 58 and 60 and then has an opportunity to answer another question as above depending on the space upon which the player piece 64 lands. If the player does not correctly answer the question, the next player rolls the dice 58, 60 and repeats the procedure outlined above for the first player.

(3) A player is given a fixed time within which a question must be answered. The fixed time, which may be sixty seconds, is determined by timing device 62.

(4) The two letters on the second spaces 34 are used in case a player piece 64 lands on the same space a second time and the same facet of dice 58 is facing upwardly, as in the previous occasion. The top letter is used first and the lower letter is used next.

(5) The answers to the general subject category question appears on the same card as the general subject category question appears on. However the answer is so placed on the card so that the question can be read without seeing the question. For example, the answer could be placed on the opposite side of the card from the side the question appears on, or a removable cover could be placed over the answer or the card could be folded to hide the answer. Other ways will come to mind to hide the answer from the question.

(6) The answers to the questions appearing on the second spaces appear on the alphabet answer cards 54 and 56. The answer cards are arranged in alphabetical order. Thus if the player rolls the letter/color dice and lands on a second space 34 colored red and the dice 58 letter colored red is an "E", the player's answer to the question must start with the letter E. To find the answer the player selects the alphabet answer card for the letter "E". The player then looks at the number of said second space 34 and if the number is "9", then the player looks under the number "9" on the "E" alphabet answer card for the correct answer or answers to the question.

(7) The first player to land on any of the center finish spaces indicated on the game board 30 and correctly answer the question thereon wins the game.

While I have described may invention in considerable detail. various modifications, substitutions and equivalents may be used within the spirit of my invention.

I claim:

1. A board game comprising (a) a plurality of separate player pieces, (b) board means having a plurality of first and second spaces defining a travel path for said player pieces, (c) said first spaces including indicia referring to a general subject category and said second spaces including indicia referring to a question, a number and a color, (d) random chance control means for controlling the movement of said player pieces along said path of said board means, said random chance control means includes a number for determining the number of said first and second spaces to be advanced by one of said player pieces, colors corresponding to the color indicia of said second spaces and a letter of the alphabet corresponding to the letters of alphabet answer cards, (e) a plurality of general subject category cards corresponding to said indicia of said first spaces with each of said general subject category cards having questions and answers thereon, (f) a plurality of said alphabet answer cards corresponding to said indicia of said second spaces with said alphabet answer cards having answers to said question on said second spaces thereon with said alphabet answer cards arranged in alphabetical order and each alphabet answer card further listing answers by number, whereby during play of said board game when one of said player pieces lands on one of said second spaces, a player is asked to provide an answer to said question on said one of said second spaces beginning with the letter on said random chance control means which has the same color as the color on said one of said second spaces with the answer to said question appearing on the alphabet answer card having the same letter as said letter on said random chace control means.

2. The board game of claim 1 wherein said second spaces also include indicia referring to a letter of the alphabet and said letter on said second space is used in like manner as said letter on said random chance control means.

3. The board game of claim 1 further comprising means for timing an interval of time.

4. The board game of claim 1 wherein said random chance control means comprises a pair of dice with each dice having six facets, the facets of one dice numbered from 1 through 6 and the facets of the other dice divided into sectors with each sector having a different color and a letter of the alphabet in each sector.

5. The board game of claim 1 wherein said plurality of first and second spaces define more than one travel path.

6. The board game of claim 1 further comprising means for timing an interval of time, said random chance control means comprises a pair of dice, each dice having six facets. each facet of one dice numbered from 1 through 6 and each facet of the other dice divided into a plurality of sectors with each sector being a different color and having a letter of the alphabet therein, said plurality of first and second spaces define more than one travel path, and said second spaces include indicia referring to a letter of the alphabet and said letter on said second space is used in like manner as said letter on said random chance control means.

* * * * *